United States Patent [19]

Hyllberg et al.

[11] Patent Number: 4,493,256

[45] Date of Patent: Jan. 15, 1985

[54] VOLTAGE APPLICATOR FOR LIMITING CHARGE DISTRIBUTION IN ESA PRINTING EQUIPMENT

[75] Inventors: Bruce E. Hyllberg, Gurnee; George B. Brands, Wilmette, both of Ill.

[73] Assignee: American Roller Company, Union Grove, Wis.

[21] Appl. No.: 584,614

[22] Filed: Feb. 29, 1984

[51] Int. Cl.[3] ..... B41F 5/00

[52] U.S. Cl. ..... 101/216; 101/DIG. 13

[58] Field of Search ..... 101/212, 216–219, 101/152, 153, 170, 426, 174, 176, DIG. 13; 29/125, 130, 132; 355/3 DR; 315/307, 291

[56] References Cited

U.S. PATENT DOCUMENTS

| | | | |
|---|---|---|---|
| 2,520,504 | 8/1950 | Hooper | 101/219 X |
| 3,477,369 | 11/1969 | Adamson et al. | 101/170 X |
| 3,625,146 | 12/1971 | Hutchison | 101/153 |
| 4,099,462 | 7/1978 | Coberley et al. | 101/170 X |

OTHER PUBLICATIONS

Hurletron Altair, Danville, Illinois, Drawing No. 3959-18, Sheets 1 and 2, Jun. 13, 1983.

Hurletron Altair Brochure, "Electrosist System" four pages, date unknown.

*Primary Examiner*—J. Reed Fisher

*Attorney, Agent, or Firm*—Quarles & Brady

[57] ABSTRACT

Several embodiments of a voltage applicator device are disclosed for contacting an impression roller in an electrostatically assisted (ESA) printing machine. The voltage applicator device has rolling conductive surfaces which are spaced apart and selectively connected to a voltage source to limit voltage application to the width of one or more partial webs being run through the machine. In the various embodiments, the conductive surfaces outside the web area can be left unconnected, but are preferably grounded or connected to a voltage of opposite polarity, to drain current from portions of the impression roller lying beyond the web. The rolling conductive surfaces can be formed as individual rollers or preferably as a segmented voltage application roller carrying electrical circuitry to connect the conductive surfaces to the voltage source through a roller journal shaft.

9 Claims, 13 Drawing Figures

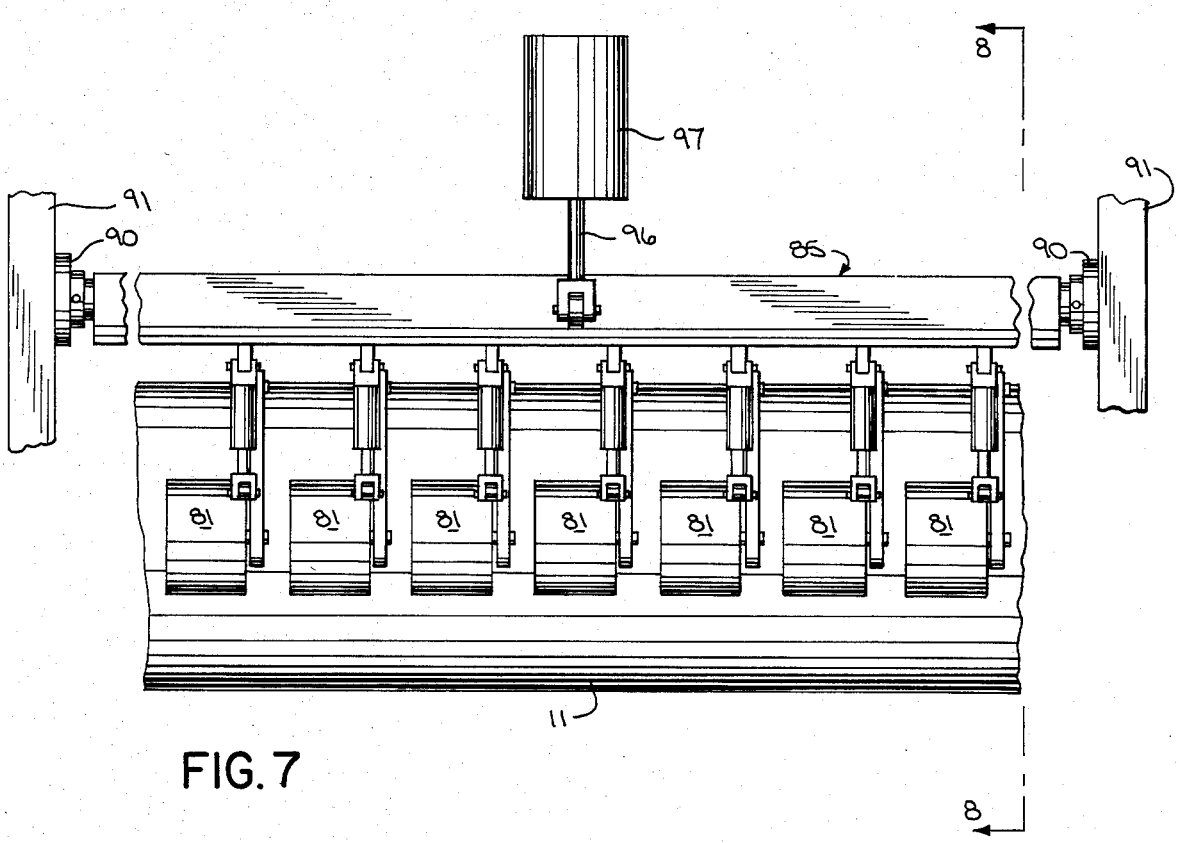
FIG. 7
FIG. 8
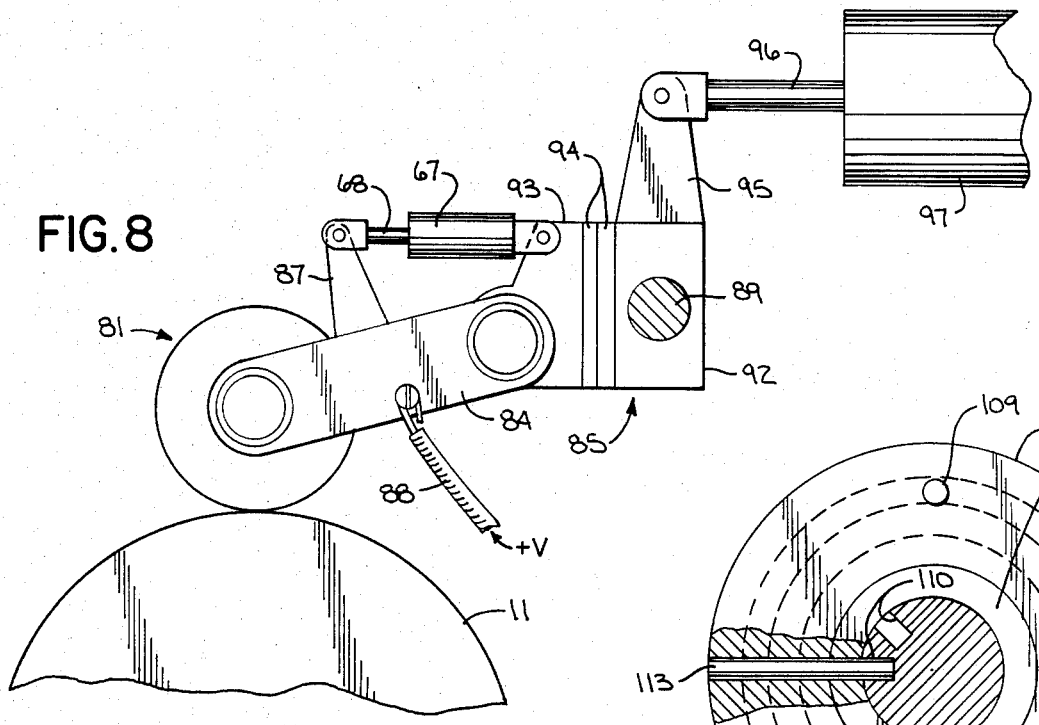
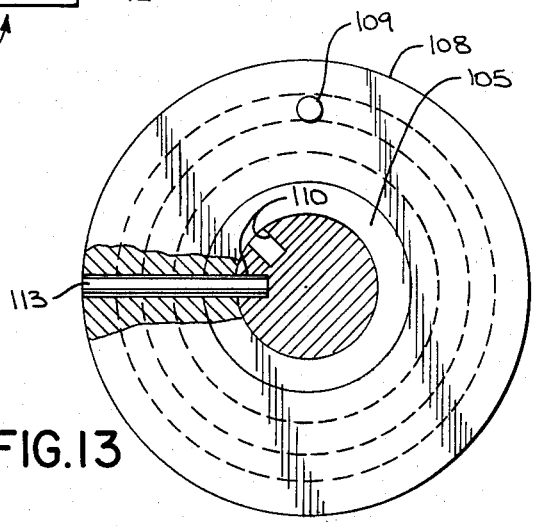
FIG. 13

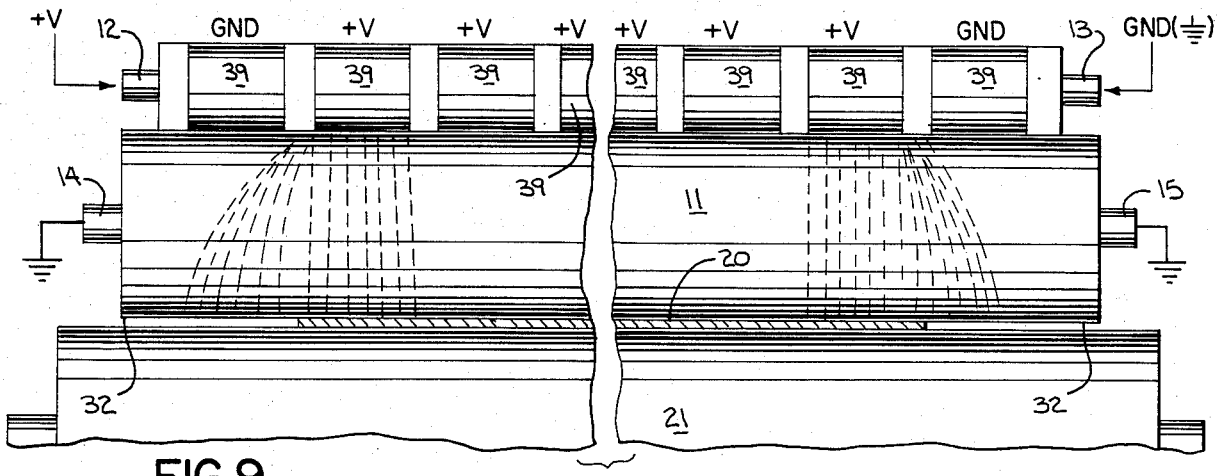
FIG.9
FIG.11
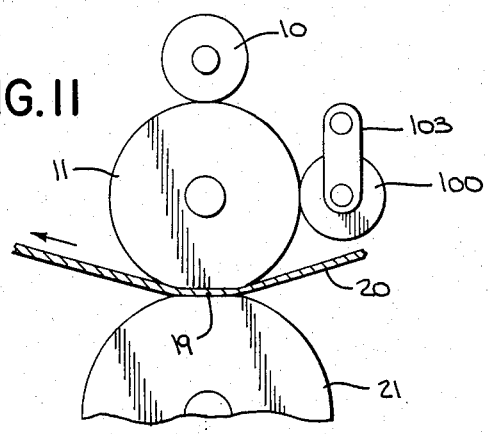
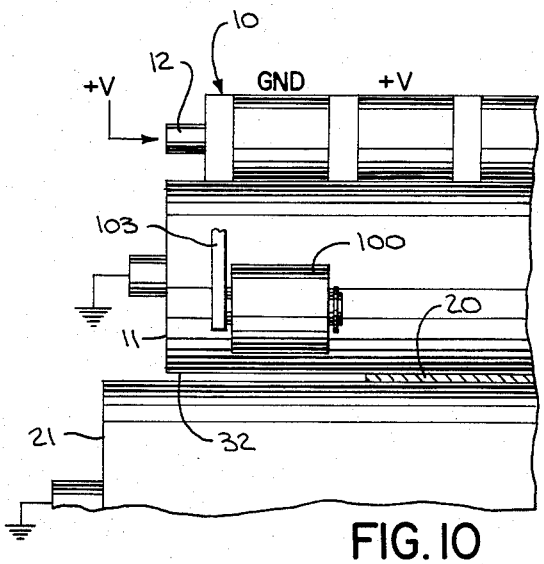
FIG.10
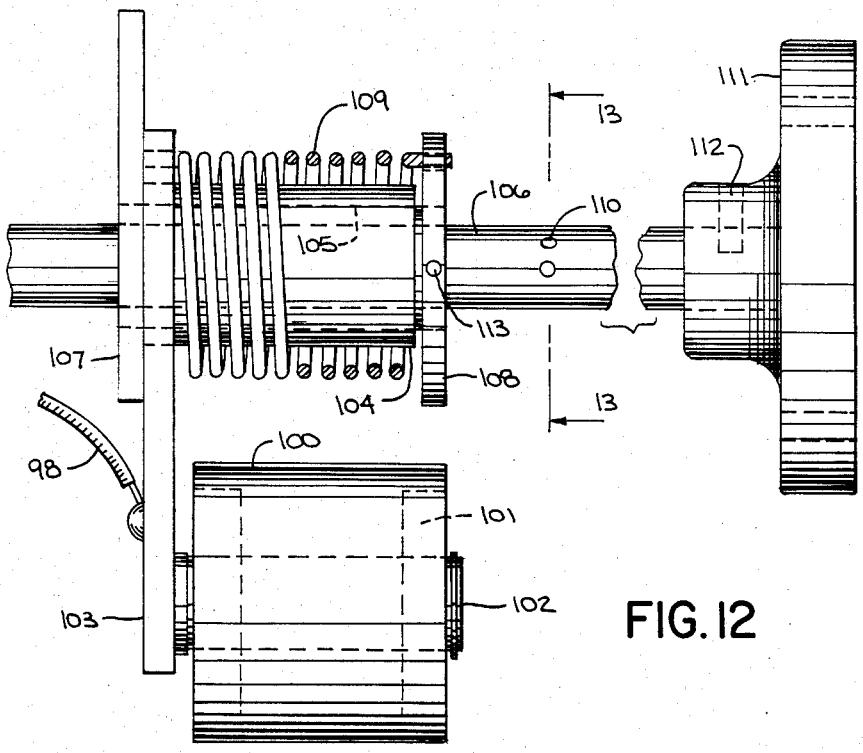
FIG.12

VOLTAGE APPLICATOR FOR LIMITING CHARGE DISTRIBUTION IN ESA PRINTING EQUIPMENT

BACKGROUND OF THE INVENTION

The invention relates to rollers used in electrostatically assisted printing machines.

Printing machines have been developed in which the transfer of ink from a printing design cylinder to a web of non-conducting material, such as paper, is assisted by the electrostatic attraction of ink to the web. The electrostatic phenomenon allows for the transfer of ink with reduced mechanical pressure. The ink is transferred in a nip region that is formed where a resilient outer covering of an impression roller bears on the printing design cylinder through the web. In one example of the prior art, the nip region is defined by a flattening of the impression roller that extends about one-half inch along its circumference and further extends across the width of the web.

In printing machines of this type, the impression roller may be connected to one terminal of a voltage source and the printing design cylinder may be connected to the other terminal to apply a voltage across the web. Since the machine frame is typically grounded, the impression roller has been mounted in insulated bearings to prevent short circuiting a positive voltage applied to it. The voltage has been applied to a semiconductive covering which is formed around the insulated core of the impression roller. In the earliest machines a brush and slip-ring arrangement was used to conduct electrical current around the insulated bearings to this outer covering. In later machines the outer covering was charged by contact with a metal back-up roller that was pressed against the impression roller. As the impression roller is subject to more wear than the back-up roller, it was found advantageous to eliminate the brush and slip-ring arrangement which required service when the impression roller was changed.

In the packaging industry it is often necessary to run "partial webs" of a width shorter than the length of the impression roller. The operation of impression rollers on print cylinders in areas outside the web causes two problems. The first is sparking, which is due to the voltage difference across the relatively small or intermittent air gap between the impression roller and the print cylinder. The second problem is ink build-up in the areas outside the web.

One approach to solving these problems has been the selective application of voltage to the impression roller. This has been accomplished by removing the metal back-up roller and substituting a row of stainless steel sliding blades which are spaced along the length of the impression roller. Each sliding blade is movable between one position where it bears against the impression roller and another position where it is retracted, so as not to contact the impression roller. By selecting sliding blades which contact the impression roller in a middle region, voltage can be applied over the web, but not in areas outside the web. The sliding blades are not a suitable solution, however, because they are subject to unusual wear and also subject the impression roller to greater wear in the areas contacted by the blades.

SUMMARY OF THE INVENTION

The invention is incorporated in several embodiments of a charge applicator device in which a plurality of rolling conductive surfaces are spaced along the length of an impression roller. The rolling surfaces are supported by at least one cylindrical core which has a journal shaft for connection to a voltage source. The invention then provides various alternatives for connecting selected ones of the rolling conductive surfaces in an electrical circuit between the conductive journal shaft and the impression roller to apply an electrical voltage to a longitudinal portion of the impression roller that is limited by the width of the web.

The general object of the invention is to provide a charge applicator device for reducing charge in areas between the impression roller and a printing design cylinder that lie along and beyond the edges of a partial web. The invention further provides a roller-type charge applicator device to improve the wear characteristics of both the charge applicator and the impression roller.

A further object of the invention is to allow the effective width of the charge applicator to be controlled either by electrical switches or by positioning of the conductive surfaces.

A further aspect of the invention relates to grounding or applying a voltage of opposite polarity to the impression roller in areas outside the web. This further reduces voltage and charge in air gaps which lie between the impression roller and the printing design cylinder outside the area of the web. This object can be achieved with the applicator roller or by the addition of auxiliary rollers that contact the impression roller in areas outside the web.

The foregoing and other objects and advantages of the invention will appear from the following description in which reference is made to the accompanying drawings which form a part hereof, and in which there is shown by way of example a preferred embodiment and several alternative embodiments of the invention. These embodiments do not necessarily represent the full scope of the invention, however, as the invention is defined by the claims following the description.

BRIEF DESCRIPTION OF THE DRAWINGS

FIG. 7 is a top view of a plurality of applicator rollers providing a fourth embodiment of the invention;

FIG. 8 is a section view taken in the plane indicated by line 8—8 in FIG. 7;

FIG. 9 is a schematic view of the rollers seen in FIG. 1;

FIG. 10 is a fragmentary schematic view of the rollers seen in FIG. 9 with the addition of an auxiliary roller of the invention;

FIG. 11 is a left end view of the rollers in FIG. 10;

FIG. 12 is a detail view of the auxiliary roller in FIG. 10; and

FIG. 13 is a section view taken in the plane indicated by line 13—13 in FIG. 12.

DETAILED DESCRIPTION OF THE PREFERRED AND ALTERNATIVE EMBODIMENTS

Figure 1:
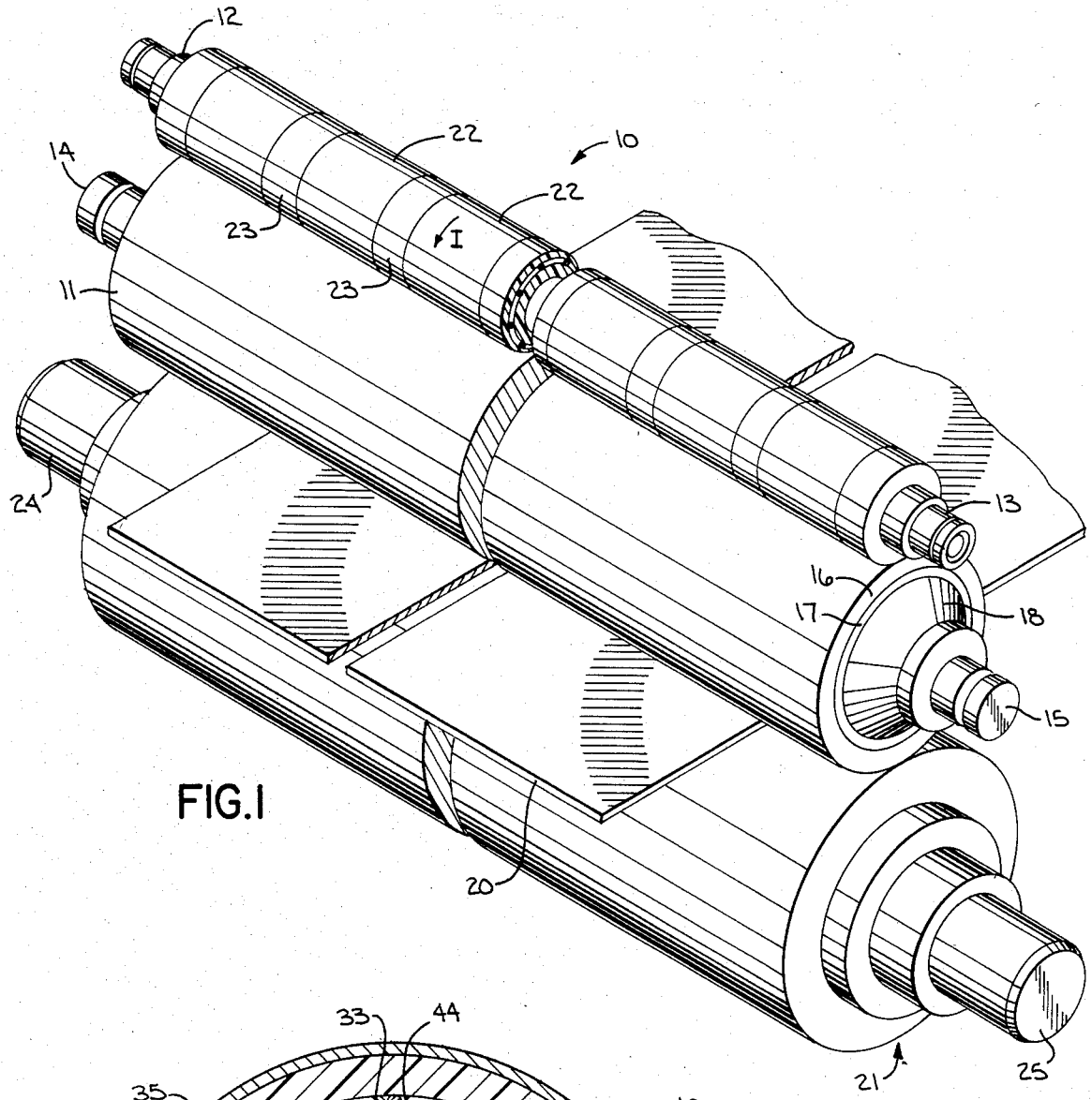
FIG. 1 is a perspective view of a preferred embodiment of an applicator roller of the invention in relation to the other rollers in a printing machine.

FIG. 1 shows three rolling members from an electrostatically assisted (ESA) printing machine of the type described and illustrated in Adamson et al, U.S. Pat. No. 3,477,369, issued Nov. 11, 1969. As described there, a roller functioning generally like the applicator roller 10 in FIG. 1 and a roller functioning generally like the impression roller 11 are journaled in a sliding framework to move up and down together. A voltage is applied to the applicator roller 10 through one of its journal shafts 12 and 13 through an electrical contact that is otherwise insulated from the portions of the sliding framework receiving the journal shafts 14 and 15 of the impression roller 11. The ESA operating voltage applied to the applicator roller 10 in this instance is 3000 DC volts. In other embodiments it can be as low as 500 DC volts or as high as 5000 DC volts.

It is known that the applicator roller 10 can be made electrically conductive so as to apply a voltage to the impression roller 11. Impression rollers in prior art have included a two-layer roller with a resilient, semiconductive outer covering over an insulated cylindrical core, and a three-layer roller with a conductive layer between the semiconductive covering and the insulated cylindrical core. In each of these, the insulation prevents the outer covering from being grounded through the journal shafts 14 and 15 and the sliding framework that receives them.

The impression roller 11 in FIG. 1 also includes a semiconductive resilient covering 16, an insulated cylindrical core 17, and hubs 18 by which the roller 11 can be supported by the journal shafts 14 and 15. Like the impression rollers of the prior art, current is conveyed around the circumference of the impression roller 11 to a nip region 19 (seen in FIG. 11) where a web 20 is pressed between the impression roller 11 and a printing design cylinder 21.

This impression roller 11 of FIG. 1, however, preferably has been modified as described in a copending application filed concurrently herewith and entitled "Impression Roller for Limiting Charge Distribution". It will be noted that the web 20 in FIG. 1 has a width less than the length of the impression roller 11, and is therefore referred to as a "partial" web. Unlike either of the impression rollers of the prior art, the impression roller 11 of FIG. 1 has greater electrical resistance in the longitudinal direction than in the circumferential direction, so that current applied to the impression roller 11 in alignment with the partial web 20 will not be conducted in large measure to the end portions of the impression roller 11 outside the web 20. This also requires, however, a selective application of voltage to the impression roller 11. To provide this selective application, the applicator roller 10 in FIG. 1 has conductive bands 22 spaced along its length and separated by insulating bands 23. By selectively connecting the conductive bands 22 through the journal shafts 12 and 13 to the source of ESA operating voltage, the region in which voltage is applied to the impression roller 11 can be limited to the width of the partial web 20, while maintaining mechanical pressure evenly along the top of the impression roller 11.

The printing design cylinder 21 is conductive on its surface and is grounded through its journal shafts 24 and 25. The web 20 may be paper, paperboard, fabric or plastic film, and in this example it is a packaging material, all of which are dielectric or substantially non-conductive materials. The ESA operating voltage produces a current through the outer covering of the impression roller 11 and also causes a voltage difference and an electrostatic field across the partial web 20 in the nip region. Due to the voltage drop through the impression roller 11, the voltage in the nip region 19 is considerably less than the applied voltage. A nip voltage of 100 DC volts per mil of web thickness is recommended. This voltage enables the impression roller 11, the web 20 and the printing cylinder 21 to act like a capacitor with plates of large area that are short distance apart. The electrostatic field set up by this capacitor assists the mechanical pressure of the impression roller 11 in transferring ink from the printing design cylinder 21 to the web 20.

Figure 3:
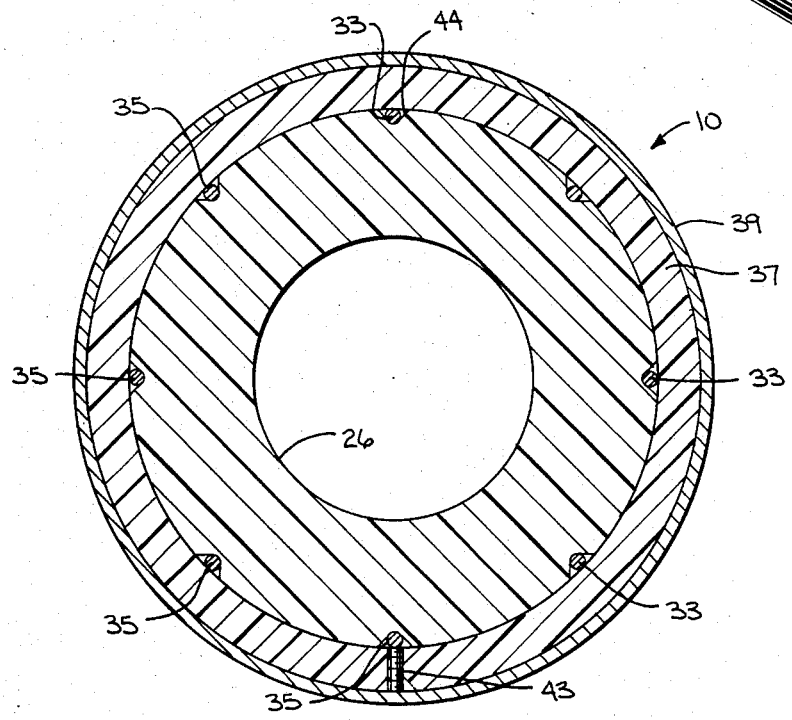
FIG. 3 is a cross section view of the applicator roller taken in the plane indicated by line 3—3 in FIG. 2.
Figure 2:
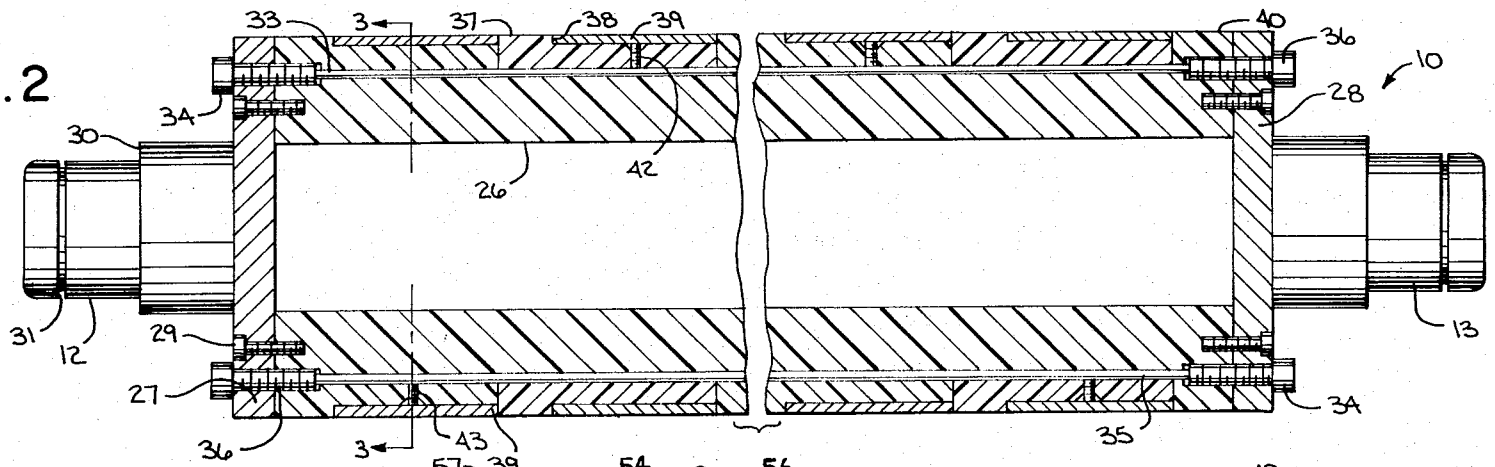
FIG. 2 is a longitudinal section view of the applicator roller of FIG. 1.

Referring to FIGS. 2 and 3, the preferred embodiment of the applicator roller 10 includes a thick-walled tube 26 of an insulating material such as polypropylene. A pair of end plates 27 and 28 close over the opposite ends of the tube 26 and are fastened with Allen-head screws 29 to provide a roller core. The journal shafts 12 and 13 are formed on the end plates 27 and 28 with a reduction in diameter that forms a shoulder 30 to abut an annular journal bearing (not shown) in the sliding framework of the printing machine. The outermost portions of the journal shafts 12 and 13 each have a circumferential groove 31 that receives a snap ring (not shown) for retaining the journal shafts 12 and 13 within their respective bearings.

As seen in FIG. 2, there is a first core conductor 33 at the top which extends longitudinally relative to the core and is electrically connected by a conductive Allen-head screw 34 to the left end plate 27. A second core conductor 35 extends longitudinally along the bottom of the tubular core and is connected by a second conductive screw 34 to the right end plate 28. Each of the conductors 33, 35 is insulated from an opposite one of the end plates 27, 28 by an insulating screw 36. A plurality of sleeves 37 of insulating material are arranged side by side along the length of the tube 26. The insulating material may be nylon, phenolic or a non-conductive rubber. Each of the insulating sleeves 37 includes a wide groove 38 for receiving a ring 39 of a conductive material. The groove 38 opens to one side of the insulting sleeve 37 so that a ring 39 can be slipped into the groove 38 and then held in place by a next sleeve 37 abutting the first sleeve 37. The conductive material of the rings 39 can be aluminum, steel or a conductive or semiconductive rubber.

To define some of the terms used above, a "conductive" rubber is one with a volume resistivity of $10^3$ ohm-centimeters or less. A non-conductive rubber is one with a volume resistivity of $10^{10}$ ohm-centimeters or more. And, a semiconductive rubber is one with a volume resistivity from $10^3$ ohm-centimeters to $10^{10}$ ohm-centimeters. When a semiconductor rubber is used for the ring conductors 39 it has a resistivity near its lower limit of $10^3$ ohm-centimeters.

To assemble the roller 10 a number of sleeves 37 and conductive rings 39 can be slid over the tube 26 and trapped between the end plates 27 and 28. Both the sleeves 37 and the rings 39 can be secured against rotation with an adhesive. At some point in the assembly it may be necessary to insert an insulating ring 40 for the purpose of closing the open side of the last groove 38.

The conductive rings 39 are electrically connected to the core conductors 33 and 35 by contacts 42 and 43, which in this embodiment are set screws extending radially through the insulating sleeves 39 to contact the core conductors 33, 35. The conductive rings 39 can then be slipped into their respective grooves 38 to contact the screws 42, 43. The conductive rings 39 in the middle portion of the roller 10 are connected by the upper core conductor 33 to the end plate 27 where the ESA operting voltage is applied, and this causes current (I) to flow around the conductive rings seen in FIG. 1 to the impression roller 11 in an area above the partial web. The conductive rings 39 outside the web 20 are connected by contacts 43 to the lower core conductor 35 seen in FIG. 2 and to the opposite journal shaft 13, which may then be groundd or connected to an opposite polarity voltage. This prevents the ESA operating voltage from being applied to the conductive rings 39 toward the ends of the roller 10 which are outside the partial web 20.

Referring to FIG. 3, the upper and lower core conductors 33 and 35 are seen at twelve o'clock and six o'clock, respectively, in longitudinal grooves 44 in the tube 26. It is also possible to use additional core conductors 33, 35 as seen in FIG. 3, with each one being connected by a contact to a respective conductive ring 39. The core conductors 33 carrying the ESA operating voltage are then connected to the left end plate 27 while the other core conductors 35 are then connected to the right end plate 28 seen in FIG. 2. By reversing the positions of the conductive and insulating screws 34 and 36 for each conductor 33, 35, the conductive rings 39 can be disconnected from one of the journal shafts 12, 13 and reconnected to the other. Thus, the region in which the ESA operating voltage is applied can be controlled and adjusted.

FIG. 9 is a schematic which shows the primary advantage of the invention. The middle conductive rings 39 are connected to apply a positive ESA operating voltage (+V) to the impression roller 11. Current flows through the impression roller 10 in the area across the web 20. Because the outlying rings 39 are grounded, no voltage is applied to areas of the impression roller 11 lying outside the web 20. Some straying or "fringing" of current (represented by the curved phantom lines in FIG. 9) will occur from the areas over the web 20 to the areas outside the web 20, but this will be limited in part by the greater resistance of the impression roller 11 in the longitudinal direction. The result is that the voltage and electrical charge across the air gaps 32 on either side of the web 20 will be substantially less than the voltage and charge across the web 20 itself. The fringing of current and charge in areas outside the web 20 can be further limited by applying a voltage to the rings 39 on ends of the roller 10 with a polarity opposite the ESA operating voltage. This opposite polarity voltage (−V) is preferably about one-half the magnitude of the ESA operating voltage, but can be increased or decreased in other embodiments according to the amount of charge-limiting that is desired. The opposite polarity voltage can be applied through the journal shaft 13 at the right end of the roller 10 in FIG. 9. The grounding or application of negative voltage to the conductive rings 39 outside the web tends to drain the stray current before it reaches the gaps 32 as shown in FIG. 9.

Usually, the full width of the web 20 is not charged, because printing is not usually done out to the edges of the web 20. Also, the conductive rings 39 could be non-uniform in size in other embodiments with a wider center ring, about the size of the web, and then smaller adjustment rings near the ends of the applicator roller 10. The multiple rings 39 are more useful, however, for multiple partial webs run side by side.

Figure 4:
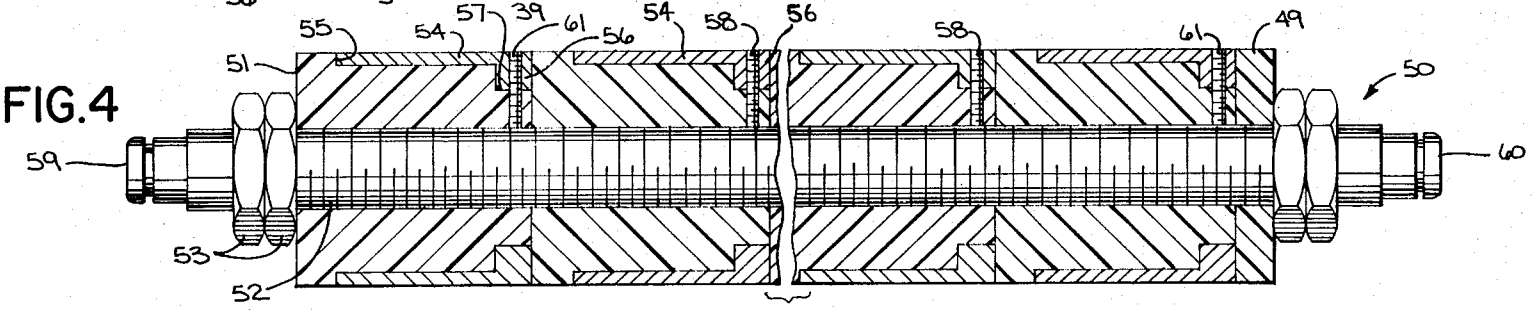
FIG. 4 is a longitudinal section view of a second embodiment of the applicator roller of the invention.

Referring to FIG. 4, there is shown an alternative embodiment of the applicator roller 50 of the invention in which insulating sleeves 51 are threaded onto a solid metal core 52 and retained at opposite ends with pairs of large nuts 53. These sleeves 51 also have grooves 55 for receiving conducting rings 54. There is also a non-grooved insulating ring 49 for completing the assembly. The conducting rings 54 have a thickened lip 56 at one end that is received in a deeper portion 57 of the groove 55 near its open side. A metal set screw 58 is threaded through this lip 56 and the reduced portion of the insulating sleeve 51 to contact the threaded metal core 52. This secures the ring 54 to the sleeve 51, which is threadingly secured to the core 52. Where it is desired to leave the rings 54 unconnected to the journal shafts 59 and 60, an insulating set screw 61 is used to fill the holes that would otherwise collect ink and dirt. This embodiment provides an advantage in assembly, and eliminates the need for adhesives, but as there is only a single conductor 52 running between the journal shafts 59 and 60, the conductive rings 54 near the ends of the roller are left unconnected for charge-limiting, rather than being grounded or connected to a DC voltage of negative polarity.

Figure 6:
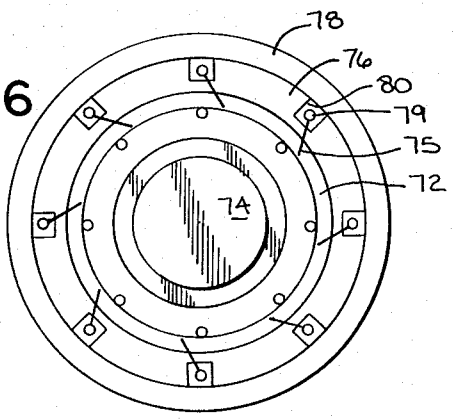
FIG. 6 is an end view of the applicator roller taken in the direction indicated by line 6—6 in FIG. 5.
Figure 5:
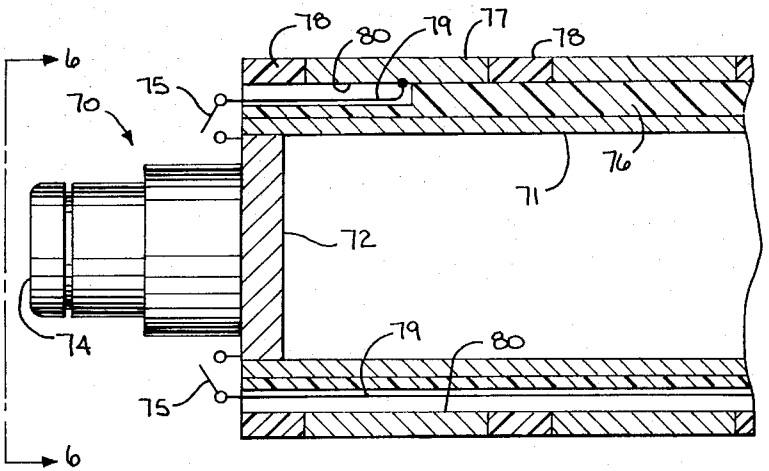
FIG. 5 is a fragmentary longitudinal section view of a third embodiment of the applicator roller of the invention.

Referring to FIG. 5, there is shown a portion of another alternative embodiment of the applicator roller 70. In this embodiment the core is formed by a metal tube 71 which receives metal end plugs 72 in its open ends. The end plugs 72 each form a journal shaft 74. The metal tube 71 is covered with a layer of insulating material 76 of the type described for the sleeves of the preferred embodiment. This layer 76 is bonded to the tube 71. Rings 77 of conductive material shaped like those in the preferred embodiment are slid onto the core, where they are spaced at regular intervals and attached to the insulating material 76 with a suitable adhesive. The intervals between the conductive rings are then filled with additional portions 78 of the insulating material used in the inner layer 76. Before the conductive rings 77 are adhesively attached, they are soldered or otherwise connected electrically and mechanically to insulated wires 79 running in longitudinal grooves 80 to one end of the core as seen in FIG. 5. The wires 79 and grooves 80 are spaced around the outside of the inner insulating layer 76 as seen in FIG. 6. Each wire 79 is connected to a different one of the conductive rings 77 and thus the grooves 80 are of different lengths as seen in FIG. 5. The wires are coupled to the core at one end by on-off switches 75. Thus, when a switch is "on" or closed, it connects its associated conductive ring 77 to the journal shaft 74 where the ESA operating voltage is applied. If the switch is off, the conductive ring 77 is left unconnected. This provides a means of adjusting the applicator roller 70 for partial webs of different widths.

Referring to FIGS. 7 and 8, the ESA operating voltage can also be applied to the impression roller 11 using a plurality of axially aligned voltage applicator rollers 81. The rollers 81 seen in FIG. 7 are typically two to three inches in width and are made of a metal such as steel or aluminum. As seen in FIG. 8, each roller 81 is rotatably mounted to a traveling end of a pivotable metal support arm 84. The pivoting end of the support arm 84 is mounted on a crank arm assembly 85 for the entire set of voltage applicator rollers 81. The ESA operating voltage is applied to the rollers 81 through wires 88 connected to the roller support arms 84. These wires 88 can also be grounded or connected to a negative voltage for rollers 81 outside the web area. Individual rollers 81 are lifted up or forced down upon the impression roller 11 by hydraulic cylinders 67. These cylinders 67 are attached to the crank arm assembly 85 and have actuator shafts 68 seen in FIG. 8, which are coupled to cranks 87 on the metal support arms 84.

As seen in FIG. 7 and 8 the crank arm assembly 85 extends the length of the impression roller 11 and pivots on a rod 89 that is fastened in end bosses 90 on the frame 91 of the printing machine. As seen in FIG. 8 a base portion 92 of the crank arm assembly 85 encircles the rod 89 and is fastened to a roller support portion 93 through an insulating section 94. The base portion 92 also extends upwardly through a radial arm 95 which is pinned to an actuating shaft 96 of a larger hydraulic cylinder 97. When the larger cylinder 97 is operated to pull in its actuating shaft 96, the entire set of rollers 81 will be pivoted upward, which is useful for replacement of the impression roller 11, for general maintenance or for printing applications where electrostatic assist is not required.

During application of the ESA operating voltage to the impression roller 11, the large actuating cylinder 97 maintains the crank arm assembly 85 in the position where the rollers 81 would normally contact the impression roller 11. The individual roller cylinders 67 can then be operated to lift the rollers 81 out of contact with the impression roller 11 in areas outside the edge of a partial web being run through the machine.

FIGS. 10 and 11 illustrate another alternative for providing a negative voltage to the impression roller 11 in areas laterally to the outside of the edges of the web. This involves the use of individual rollers 100 in addition to the applicator roller 10 or set of rollers 81 for applying the ESA operating voltage. Such rollers 100 are mounted to contact the impression roller 11 at a point around its circumference from the voltage application roller 10 and towards the web 20. In this position any fringing current that tends to stray outside the lateral extent of the web 20 will be drained from the impression roller 11 before reaching the gap areas in the nip region.

Such current-draining or pickoff rollers 100 can be supported as seen in FIG. 12. There, a pickoff roller 100 is rotatably mounted on bearings 101 that roll on a spindle 102 extending laterally from a metal roller support arm 103. A wire 98 connects the arm 103 to an electrical circuit to ground or to a DC voltage of a polarity opposite the ESA operating voltage. The roller support arm 103 is attached to an outer tube 104 which rotates over an inner tube 105 on a roller assembly support rod 106. The inner tube 105 is attached to a left end plate 107, which is elongated to provide a handle, and to a right end 108 plate which is pinned to the roller assembly support rod 106. A coiled tension spring 109 has one end inserted in the right end plate 108 and an opposite end inserted into the roller support arm 103. The end plate 108 is fixed to the support rod 106, so the spring 109 provides a rotational force from five to ten pounds to hold the roller 100 against the impression roller 11.

The support rod 106 has groups of holes spaced along its length, each group including several holes 110 at varying circumferential locations as seen best in FIG. 13. This allows a pin 113 to be inserted and removed to adjust the position of the roller assembly for contact or non-contact with the impression roller 11. The entire roller assembly can also be moved along the support rod 106 and fixed at various selected locations. The support rod 106 is held in end bosses 111 with a fastener 112. The end bosses 111 are made of an insulating material to insulate the conductive rollers 100 from the frame of the machine, which is grounded.

The individual rollers 100 in FIGS. 12 and 13 can also be employed as voltage application rollers of the type seen in FIGS. 7 and 8.

Several embodiments of the invention have been described, and other variations of the details therein may be made without departing from the invention itself. Therefore, to summarize and define the invention the following claims are made.

We claim:

1. A charging device for connection to a voltage source to apply an electrostatic-assist operating voltage across an impression roller and a printing design cylinder to produce an electrostatic charge in a nip region where the impression roller bears against the printing design cylinder and where, in a portion of the nip region, a web of print-receiving material is fed between the impression roller and the printing design cylinder, the charging device comprising:

a plurality of rolling conductive surfaces spaced along the length of the impression roller;

cylindrical core means for supporting the rolling conductive surfaces along the length of the impression roller, the cylindrical core means having electrically conductive journal shafts for connection to the voltage source; and electrical connecting means coupled to the cylindrical core means for connecting selected ones of the rolling conductive surfaces in an electrical circuit between a first one of the journal shafts and the impression roller to couple the electrostatic-assist operating voltage to a portion of the impression roller contacted by the selected ones of the rolling conductive surfaces and to concentrate electrostatic charge in a corresponding portion of the nip region.

2. The charging device of claim 1, further comprising:

a body of insulating material disposed around the core means;

wherein each rolling conductive surface is formed by one of a plurality of ring conductors running circumferentially around the core means;

wherein the electrical connecting means includes a longitudinally extending, first core conductor electrically connected to a first one of the journal shafts; and wherein the electrical connecting means includes electrical contact means connecting a first ring conductor in a circuit with the first core conductor, the first one of the journal shafts and the impression roller to generate the electrostatic charge in a portion of the nip region corresponding to the width of the first ring conductor.

3. The charging device of claim 2, wherein:

the electrical connecting means includes a longitudinally extending, second core conductor that is electrically connected to a second one of the journal shafts; and wherein the electrical connecting means includes second electrical contact means extending through the body of insulating material and connecting a second ring conductor disposed outside the web in a circuit with the second core conductor and a second one of the journal shafts to reduce the electrostatic charge in a second portion of the nip region that lies outside the web.

4. The charging device of claim 2, wherein:

the electrical connecting means includes a second core conductor extending longitudinally within the core means and being connected in an electrical circuit with the first one of the journal shafts and a second one of the ring conductors;

further comprising two switches, and wherein each core conductor is electrically connected through a respective one of the two switches to the first one of the journal shafts to make and break an electrical circuit through a respective one of the ring conductors.

5. The charging device of claim 1, further comprising:

a conductive roller disposed laterally to the side of the web and in rolling contact with the impression roller, the conductive roller having means for electrical connection to apply a second voltage to the impression roller in an area outside the web.

6. The charging device of claim 5, wherein the conductive roller is axially aligned with the rolling conductive surfaces.

7. The charging device of claim 5, wherein the conductive roller is disposed around a portion of the impression roller from the rolling conductive surfaces.

8. The charging device of claim 1 further comprising other electrical connecting means coupled to the core means for connecting other selected ones of the rolling conductive surfaces in an electrical circuit between a second one of the journal shafts and the impression roller to apply a voltage opposite the polarity of the electrostatic-assist operating voltage to a portion of the impression roller contacted by the other selected ones of the rolling conductive surfaces.

9. The charging device of claim 1 further comprising other electrical connecting means coupled to the core means for connecting other selected ones of the rolling conductive surfaces in an electrical circuit between a second one of the journal shafts and the impression roller to apply a zero voltage to a portion of the impression roller contacted by the other selected ones of the rolling conductive surfaces.

* * * * *